US005212045A

United States Patent [19]

Koga et al.

[11] Patent Number: 5,212,045

[45] Date of Patent: May 18, 1993

[54] METHOD FOR IMAGE FORMATION

[75] Inventors: Masao Koga; Minoru Ohashi, both of Nagaokakyo, Japan

[73] Assignee: Mitsubishi Paper Mills Limited, Tokyo, Japan

[21] Appl. No.: 697,439

[22] Filed: May 9, 1991

[30] Foreign Application Priority Data

May 9, 1990 [JP] Japan ..... 2-120279
May 11, 1990 [JP] Japan ..... 2-121747

[51] Int. Cl.[5] ..... G03C 1/06

[52] U.S. Cl. ..... 430/264; 430/598; 430/436; 430/487

[58] Field of Search ..... 430/264, 598, 436, 487

[56] References Cited

U.S. PATENT DOCUMENTS

| | | | |
|---|---|---|---|
| 2,419,975 | 5/1947 | Trivelli et al. . | |
| 3,227,552 | 1/1966 | Whitmore . | |
| 3,386,831 | 6/1963 | Honig et al. . | |
| 3,730,727 | 5/1973 | Olivares et al. . | |
| 4,168,977 | 9/1979 | Takada et al. . | |
| 4,224,401 | 9/1980 | Takada et al. . | |
| 4,241,164 | 12/1980 | Mifune et al. . | |
| 4,243,739 | 1/1981 | Mifune et al. . | |
| 4,269,929 | 5/1981 | Nothnagle . | |
| 4,272,606 | 6/1981 | Mifune et al. . | |
| 4,272,614 | 6/1981 | Mifune et al. . | |
| 4,323,643 | 4/1982 | Mifune et al. . | |
| 4,971,890 | 11/1990 | Okada et al. | 430/264 |
| 4,978,602 | 12/1990 | Fujita et al. | 430/264 |
| 5,026,622 | 6/1991 | Yamada et al. | 430/264 |

*Primary Examiner*—Charles L. Bowers, Jr.
*Assistant Examiner*—Thomas R. Neville
*Attorney, Agent, or Firm*—Cushman, Darby & Cushman

[57] ABSTRACT

Disclosed is a method for image formation which comprises developing a silver halide photographic photosensitive material in the presence of a compound represented by the following formula [I] or [II]:

[I]

wherein Ar represents an aryl group, $R_1$, $R_2$ and $R_3$ which may be identical or different each represents a hydrogen atom, an alkyl group, an aralkyl group, an aryl group, or a heterocyclic group, with a proviso that they cannot be simultaneously hydrogen atoms, $R_1$ and $R_2$ may link to each other to form a ring, and at least one of $R_1$, $R_2$ and $R_3$ has at least one hydroxyl group as a substituent,

[II]

wherein $Ar_1$ and $Ar_2$ each represents a divalent aromatic group, $R_1$, $R_2$, $R_3$ and $R_4$ each represents a hydrogen atom, an alkyl group, an aryl group or a heterocyclic group, Rand $R_2$ may link to each other to form a ring and $R_3$ and $R_4$ may link to each other to form a ring, L represents a divalent linkage group, and n represents 0 or 1.

11 Claims, No Drawings

METHOD FOR IMAGE FORMATION

BACKGROUND OF THE INVENTION

The present invention relates to a process for development of silver halide photographic photosensitive materials and more particularly, to a photographic photosensitive material which can produce a negative image of extremely high contrast and a negative image of high sensitivity and provide good dot image quality.

To add a hydrazine to silver halide photographic emulsions or developers has been known in U.S. Pat. No. 3,730,727 (developer containing ascorbic acid and hydrazine in combination), U.S. Pat. No. 3,227,552 (use of hydrazine as auxiliary developer for obtaining direct positive color image), U.S. Pat. No. 3,386,831 (β-monophenylhydrazides of aliphatic carboxylic acids contained as stabilizer for silver halide photosensitive materials), U.S. Pat. No. 2,419,975, and Mees, "The Theory of Photographic Process", the third edition, (1966), page 281.

Among them, especially U.S. Pat. No. 2,419,975 discloses that high contrast negative images are obtained by addition of hydrazine compounds.

That is, it is disclosed that when a hydrazine compound is added to a silver chlorobromide emulsion and this emulsion is developed with a developer of a high pH of 12.8, photographic characteristics of very high contrast of more than 10 in gamma (γ) can be obtained.

However, a highly alkaline developer having a pH of near 13 is readily oxidized with air, is unstable and cannot be stored or used for a long term. Photographic characteristics of super-high contrast of more than 10 in gamma value are very useful for photographic reproduction of continuous tone image through dot image useful for printing plate or reproduction of line image irrespective of negative image or positive image.

For such purpose, a process has been employed in which a silver chlorobromide emulsion containing at least 50 mol %, preferably more than 75 mol % of silver chloride is used and development is carried out with a hydroquinone developer having very low effective concentration of sulfite ion (usually at most 0.1 mol/l) (lith development).

However, according to this process, since concentration of sulfite ion in the developer is low, the developer is extremely unstable and cannot be stored for more than 3 days.

In addition, these processes require to use a silver chlorobromide relatively high in silver chloride content and so a high sensitivity cannot be obtained.

Under the circumstances, it has been strongly desired to obtain super-high contrast photographic characteristics useful for reproduction of dot image and line image by using an emulsion of high sensitivity and stable developer.

For this purpose, silver halide photographic photosensitive materials which can provide high contrast negative photographic characteristics with using a stable developer are disclosed in U.S. Pat. Nos. 4,168,977, 4,224,401, 4,243,739, 4,269,929, 4,272,614, and 4,323,643. However, it has been found that acylhydrazine compounds used in these materials have some defects.

That is, these hydrazines are known to generate nitrogen gas during development treatment and this gas may collect in the film to form bubbles and may damage photographic images.

Therefore, compounds which can provide very high contrast photographic characteristics even with small addition amount have been demanded in order that generation of the bubbles can be decreased and simultaneously, cost for production of photosensitive materials can be reduced. Furthermore, if development is continued using these hydrazines, innumerable circular fogs (pepper fogs) are readily generated in unexposed area and image quality has been seriously damaged.

Moreover, the conventional hydrazines must be used in a large amount for obtaining high contrast and for sensitization and it is desired to use them in combination with other sensitizing means (for example, strong chemical sensitization; increase in grain size; addition of compounds which accelerate sensitization as mentioned in U.S. Pat. Nos. 4,272,606 and 4,241,164) when especially high sensitization is required as performance of photosensitive materials. However, if these sensitizing means are employed in combination with the hydrazines, sensitization and increase of fog with time may occur during storage.

Furthermore, if development is carried out with conventional hydrazines, so-called unevenness of development is apt to occur owing to uneven stirring of the developer. This unevenness of development occurs conspicuously when development is conducted by automatic processor and if development treatment is strengthened for avoiding this phenomenon, the above-mentioned pepper fogging phenomenon occurs.

Therefore, a compound has been demanded which is free from the above-mentioned problems in stability with time and the problems such as unevenness of development and pepper fog and is effective with addition of it in a small amount and besides, can be easily prepared.

SUMMARY OF THE INVENTION

One object of the present invention is to provide a silver halide photographic photosensitive material which can provide photographic characteristics of very high contrast negative gradation of more than 10 in gamma value by using a stable developer.

Another object of the present invention is to provide a negative type silver halide photographic photosensitive material containing a hydrazine which can provide good image quality free from the problems such as unevenness of development and pepper fog.

Further object of the present invention is to provide a negative type silver halide photographic photosensitive material containing a hydrazine which can give photographic characteristics of the desired very high contrast negative gradation with addition of the hydrazine in a small amount without causing adverse effect on photographic characteristics.

Another further object of the present invention is to provide a process for high contrast development of a silver halide photographic photosensitive material by adding to the development processing solution a hydrazine which is superior in processing stability (for example, free from unevenness of development or pepper fogging) and can give rapid and high contrast photographic characteristics.

DESCRIPTION OF THE INVENTION

The objects of the present invention have been attained by developing silver halide photographic photosensitive materials in the presence of a compound represented by the following formula [I] or [II].

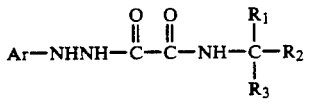

[I]

wherein Ar represents an aryl group, $R_1$, $R_2$ and $R_3$ may be identical or different and each represents a hydrogen atom, an alkyl group, an aralkyl group, an aryl group, or a heterocyclic group, with a proviso that they cannot be simultaneously hydrogen atoms, $R_1$ and $R_2$ may link to each other to form a ring structure, and at least one of $R_1$, $R_2$ and $R_3$ has at least one hydroxyl group as a substituent.

In the formula (I), examples of the aryl group represented by Ar are a phenyl group or naphthyl group which may have a substituent. Examples of the substituent are alkyl group, aryl group, hydroxyl group, halogen atom, alkoxy group, aryloxy group, alkenyl group, amino group, acylamino group, sulfonamide group, alkylideneamino group, ureido group, thiourea group, thioamide group, heterocyclic group and combination thereof.

Furthermore, Ar may have a ballast group which is commonly used in passive additives for photography such as color coupler.

The ballast group is a photographically relatively inactive group having at least 8 carbon atoms and can be selected from, for example, alkyl group, alkoxy group, phenyl group, phenoxy group and the like.

In the formula [I], the alkyl group represented by $R_1$, $R_2$ and $R_3$ is preferably an alkyl group which has 15 or less carbon atoms and may have a substituent such as hydroxyl group, carboxyl group, halogen atom, cyano group, alkoxy group, aryloxy group, aryl group, sulfo group, or substituted amino group.

In the formula [I], the aralkyl group represented by $R_1$, $R_2$ and $R_3$ is preferably an aralkyl group having 15 or less carbon atoms and examples thereof are a benzyl group or phenethyl group which may have a substituent.

In the formula [I], the aryl group represented by $R_1$, $R_2$ and $R_3$ is preferably an aryl group having or less carbon atoms and examples thereof are a phenyl group or naphthyl group which may have a substituent.

In the formula [I], the heterocyclic group represented by $R_1$, $R_2$ and $R_3$ is preferably a nitrogen-containing heterocyclic group and examples thereof are pyridyl, piperidinyl, pyrazinyl, piperazinyl, pyrimidinyl, pyridazinyl, quinolyl, isoquinolyl, naphthylizinyl, quinoxalinyl, quinazolinyl, cinnolinyl and pteridinyl groups which may have a substituent.

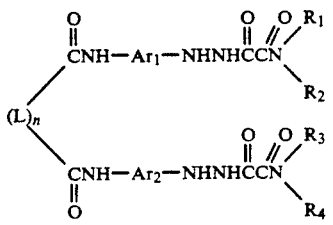

[II]

wherein $Ar_1$ and $Ar_2$ may be identical or different and each represents a divalent aromatic group, $R_1$, $R_2$, $R_3$ and $R_4$ may be identical or different and each represents a hydrogen atom, an alkyl group, an aryl group or a heterocyclic group, $R_1$ and $R_2$ may link to each other to form a ring and $R_3$ and $R_4$ may link to each other to form a ring, L represents a divalent linkage group, and n represents 0 or 1.

In the formula [II], examples of the divalent aromatic group represented by $Ar_1$ and $Ar_2$ are phenylene and naphthylene groups which may have a substituent. Examples of the substituent are alkyl group, aryl group, halogen atom, alkoxy group, aryloxy group, alkenyl group, amino group, acylamino group, sulfonamide group, hydroxyl group, alkylideneamino group, thiourea group, thioamide group, heterocyclic group and combination thereof.

In the formula [II], the alkyl group represented by $R_1$, $R_2$, $R_3$ and $R_4$ is preferably an alkyl group having 30 or less carbon atoms and may have a substituent such as a halogen atom, a hydroxyl group, a cyano group, a carboxyl group, an alkoxy group, an aryloxy group, a sulfo group, an aryl group, or a substituted amino group.

In the formula [II], examples of the aryl group represented by $R_1$, $R_2$, $R_3$ and $R_4$ are a phenyl and naphthyl group which may have a substituent.

Preferred examples of the substituent are alkyl group, aryl group, hydroxyl group, halogen atom, alkoxy group, aryloxy group, alkenyl group, amino group, acylamino group, sulfonamide group, alkylideneamino group, heterocyclic group and combination thereof.

In the formula [II], the heterocyclic group represented by $R_1$, $R_2$, $R_3$ and $R_4$ represents a monocyclic or bicyclic heterocyclic ring and these rings may have a substituent.

In the formula [II], L represents a divalent linkage group and examples thereof are linkage groups represented by the following formula [III], [IV] or [V]:

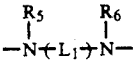

[III]

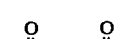

[IV]

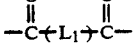

[V]

In the formulas [III], [IV] and [V], the divalent linkage group represented by $L_1$ means an atom or atomic group containing at least one of C, N, S, and 0 and examples thereof are alkylene group, alkenylene group, alkynylene group, arylene group, —O—, —S—, —NH—, —N=, —CO—, and —$SO_2$— (these groups may have a substituent) and combination thereof.

In the formula [III], $R_5$ and $R_6$ each represent a hydrogen atom, an alkyl group, an aryl group or a heterocyclic group and $R_5$ and $R_6$ may link to each other to form a ring.

Examples of the compounds represented by the formula [I] are enumerated below, but the present invention is not limited thereto.

I-1.
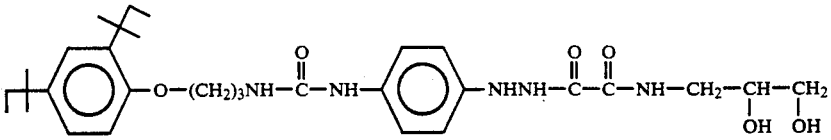
I-2.
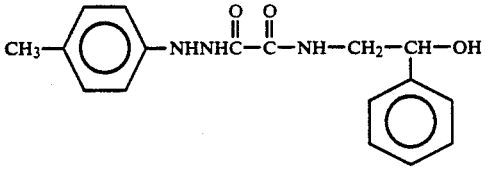
I-3.
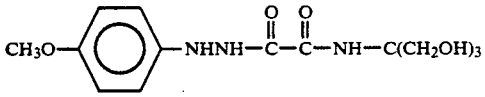
I-4.
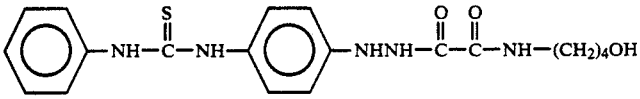
I-5.
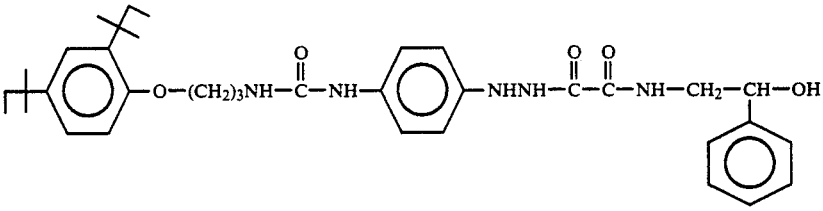
I-6.
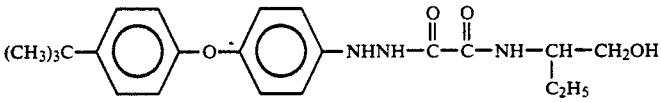
I-7.
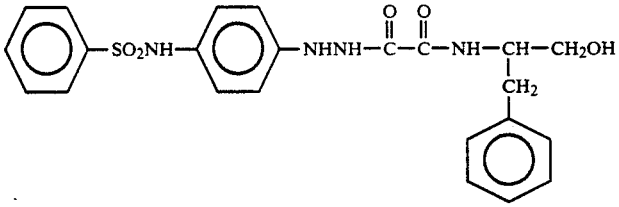
I-8.
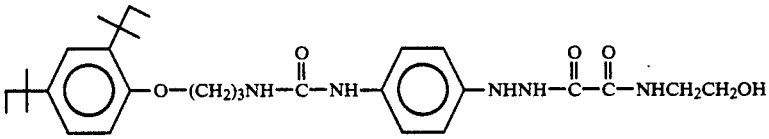
I-9.
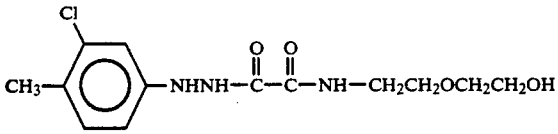
I-10.
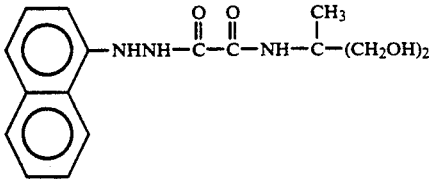

-continued
I-11.
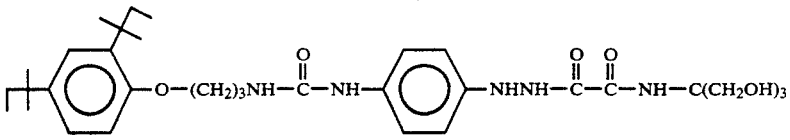
I-12.
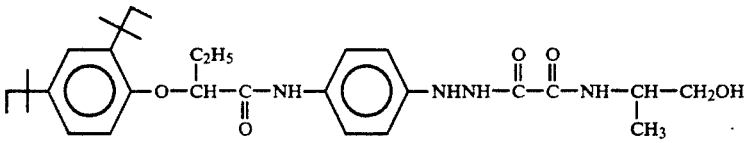
I-13.
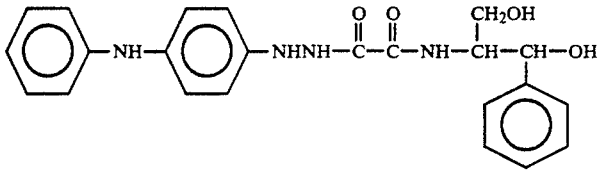
I-14.
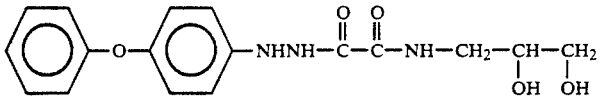
I-15.
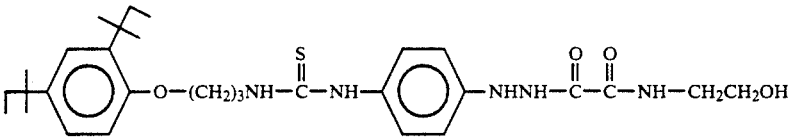
I-16.
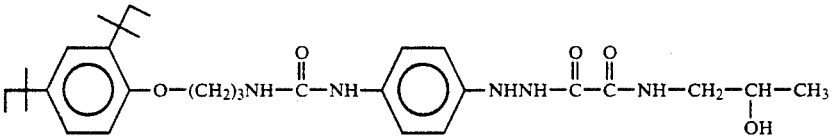
I-17.
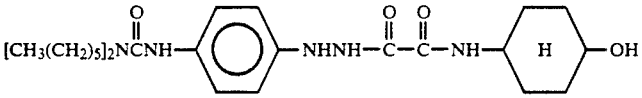
I-18.
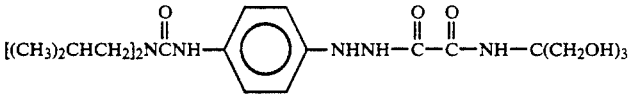
I-19.
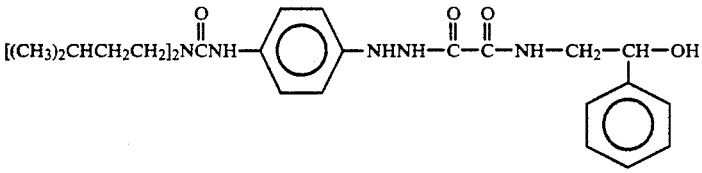
I-20.
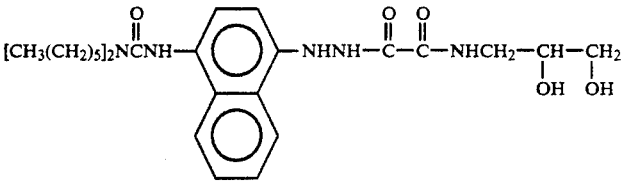

-continued
I-21.
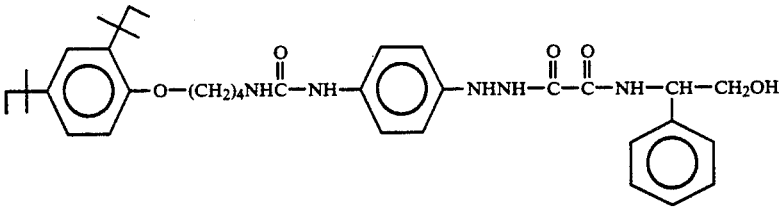
I-22.
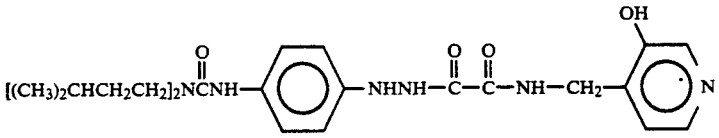
Examples of the compounds represented by the formula [II] are enumerated below, but the present invention is not limited thereto.
II-1.
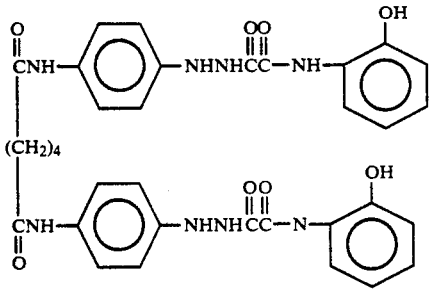
II-2.
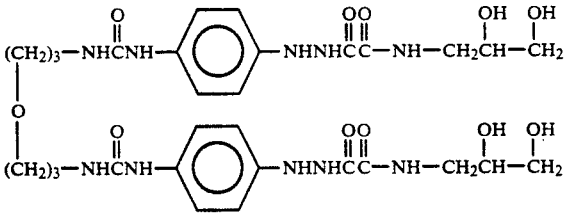
II-3.
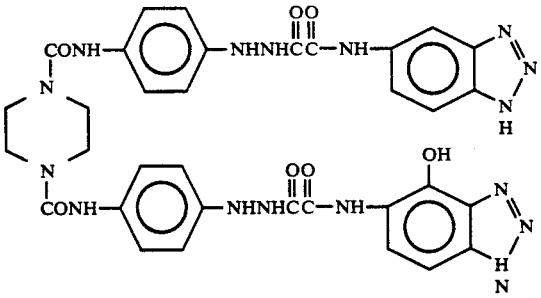

-continued
II-4.
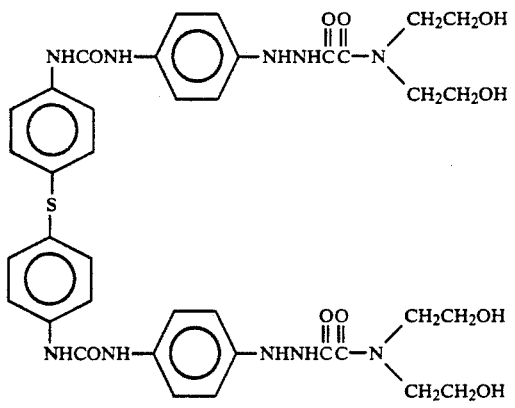
II-5.
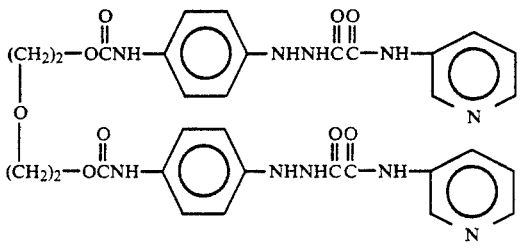
II-6.
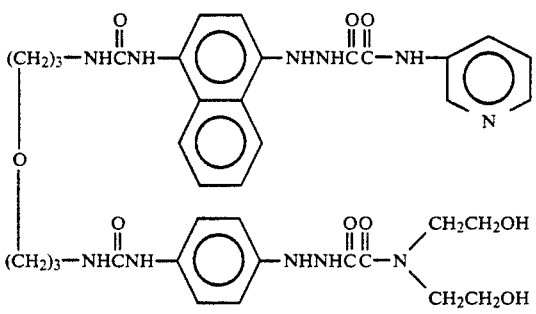
II-7.
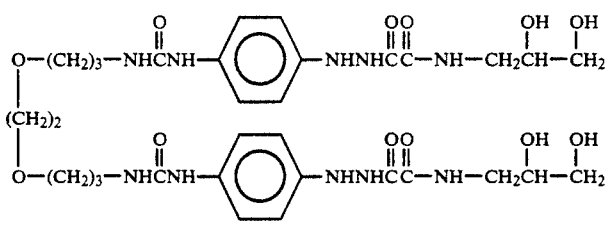
II-8.
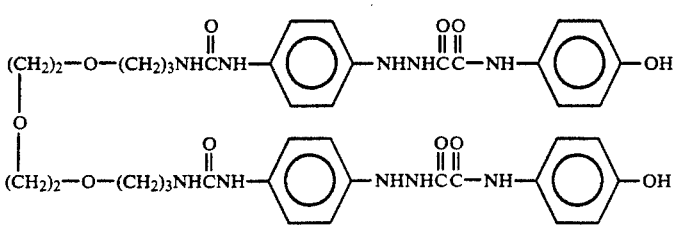

-continued
II-9.
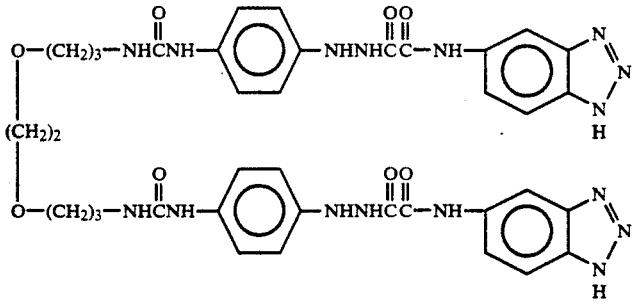
II-10.
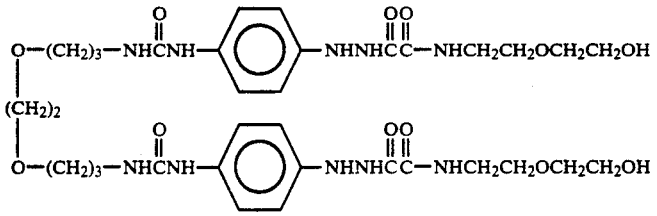
II-11.
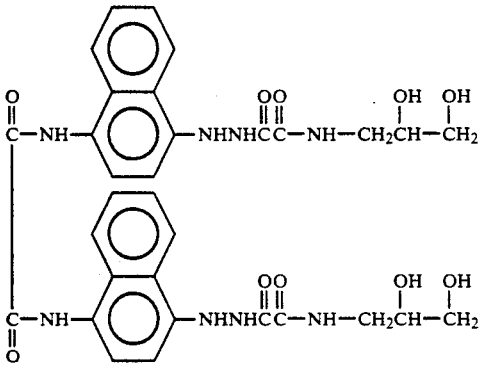
II-12.
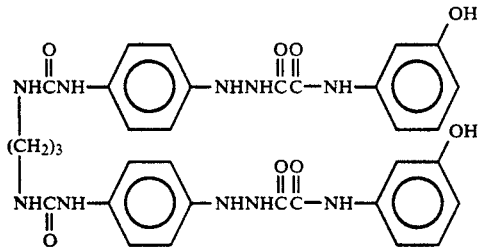
II-13.
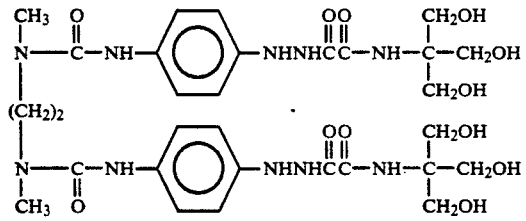
Next, process of preparation of the compound used in the present invention will be explained referring to specific examples.
PREPARATION EXAMPLE 1
Preparation of Compound I-1 exemplified hereinabove
Scheme of preparation:

Scheme of preparation:

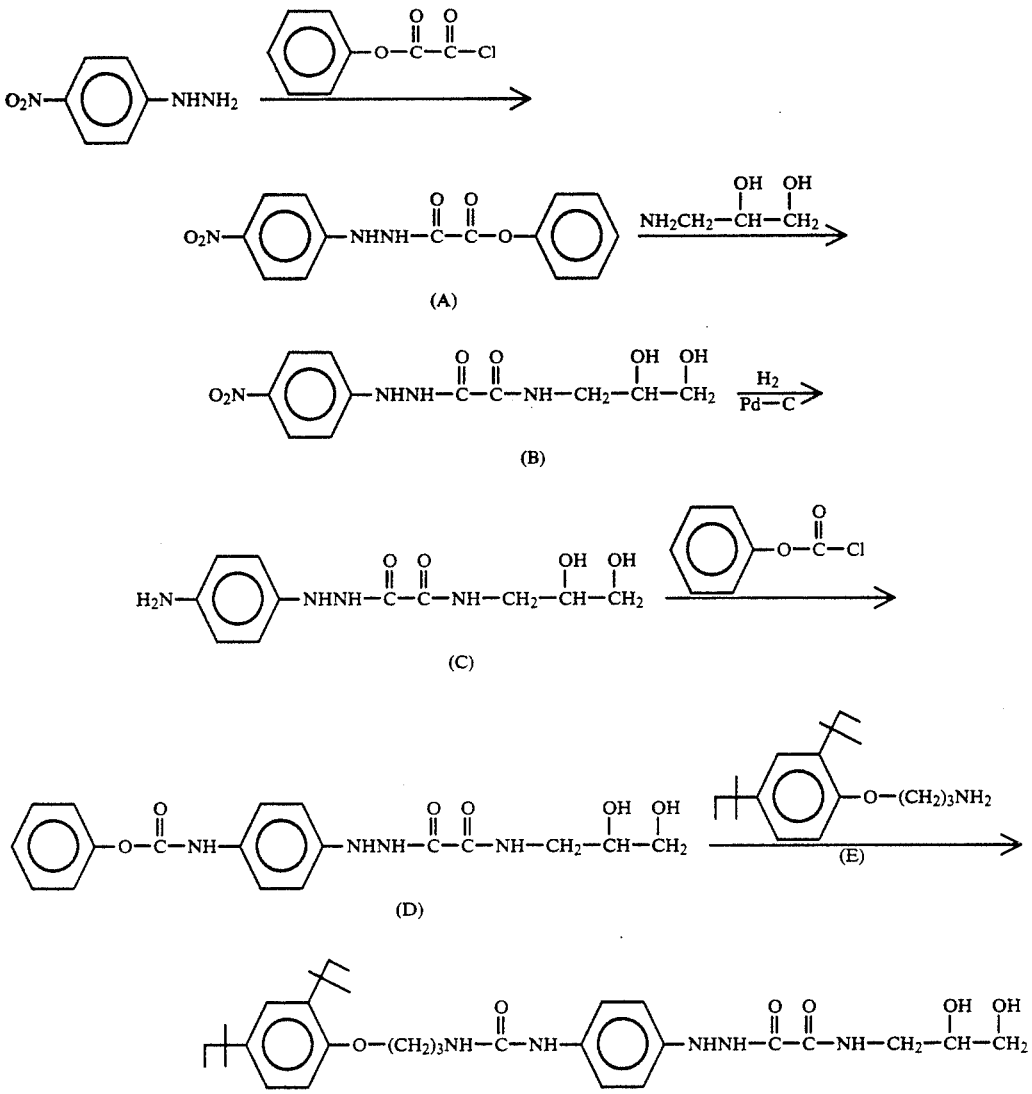

19.4 g of phenoxalyl chloride was dissolved in 300 ml of dioxane. Under stirring at room temperature, to the solution was gradually added dropwise a solution which was prepared by dissolving 15.3 g of p-nitrophenylhydrazine in 250 ml of dioxane and to which 14.6 g of triethylamine was added. After completion of the addition, the solution was stirred at room temperature for 30 minutes. Then, the precipitated crystal was filtered off and the filtrate was concentrated under reduced pressure. The residue was purified by silica gel column chromatography to obtain 24.3 g of Compound (A).

Then, 0.9 g of 3-aminopropanediol was dissolved in 100 ml of dioxane and thereto was added 3.0 g of Compound (A) and this was heated over water bath for 40 minutes. After completion of reaction, the reaction mixture was concentrated under reduced pressure and the residue was recrystallized from ethanol to obtain 1.5 g of Compound (B).

Melting point: 157°-158° C.

Then, 1.34 g of Compound (B) was dissolved in 100 ml of methanol and subjected to catalytic reduction in the presence of Pd/C catalyst to obtain 0.9 g of Compound (C). Melting point: 160° C.

Then, 0.5 g of Compound (C) was dissolved in 100 ml of dioxane and thereto was added 0.2 g of triethylamine. Under stirring at room temperature, to the solution was gradually added dropwise a solution prepared by dissolving 0.3 g of phenyl chlorocarbonate in 5 ml of dioxane. After completion of the addition, the solution was stirred at room temperature for 1 hour. The precipitated crystal was filtered off and filtrate was concentrated under reduced pressure. The residue was washed with ethanol to obtain 0.5 g of Compound (D). Melting point: 218° C. (dec.).

Then, 5 ml of dioxane was added to 0.19 g of Compound (D) and 0.16 g of Compound (E) and the mixture was reflexed with heating for 7 hours.

After completion of the reaction, the reaction mixture was concentrated under reduced pressure and the residue was washed with ethanol and ether to obtain 0.12 g of the desired Compound I-1. Melting point: 161° C. (dec.).

PREPARATION EXAMPLE 2

Preparation of Compound II-7 exemplified above.

Scheme of preparation:

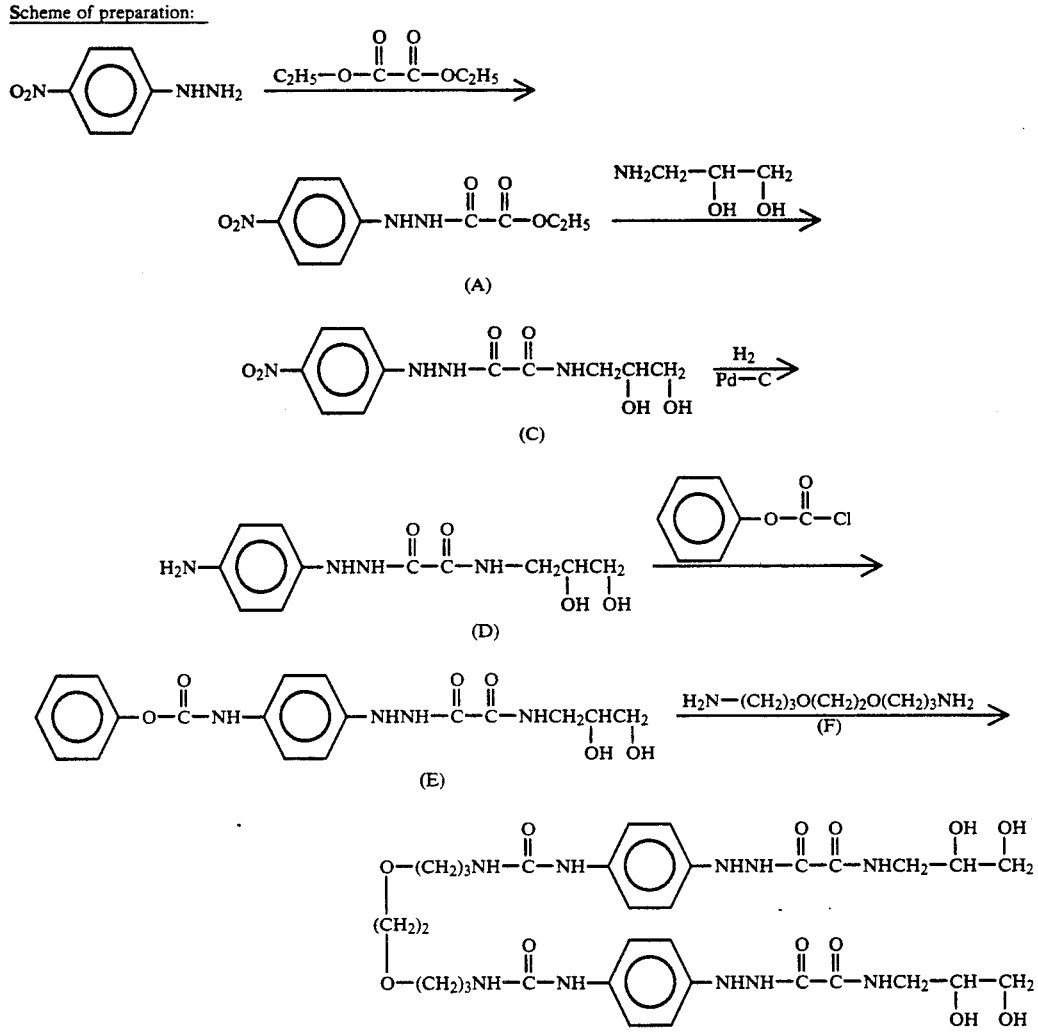

Compound II-7

A mixture of 22.5 g of p-nitrophenylhydrazine and 75 ml of diethyl oxalate was heated over a water bath for 7 hours. Then, the mixture was cooled and the precipitated crystal was collected by filtration and washed with ethanol several times to obtain Compound (A).

Yield: 30.1 g; Melting point: 178°-179° C.

7.7 g of Compound (B) was dissolved in 500 ml of dioxane and thereto was added 14.3 g of Compound (A). The mixture was heated for 2.5 hours over water bath and the precipitated crystal was collected by filtration and washed with ethanol to obtain Compound (C).

Yield: 15.6 g; Melting point: 152° C. (dec.).

15.5 g of Compound (C) was dissolved in 1000 ml of methanol and subjected to catalytic reduction in the presence of Pd-C catalyst to obtain Compound (D).

Yield: 9.3 g; Melting point: 163° C. (dec.).

9.4 g of Compound (D) was dissolved in 1500 ml of dioxane under heating and thereto was added 3.7 g of triethylamine. Under stirring at room temperature, to the solution was added dropwise a solution prepared by dissolving 5.8 g of phenyl chlorocarbonate in 100 ml of dioxane. After stirring for 30 minutes, the precipitated triethylamine chloride was filtered off and the solvent was distilled off under reduced pressure. Then, ethanol was added to the residue and precipitate was collected by filtration. The crystal was washed with ethanol to obtain Compound (E).

Yield: 10.5 g; Melting point: 214° C. (dec.).

5.3 g of Compound (E) and 1.2 g of Compound (F) were refluxed in 100 ml of dioxane for 3 hours. The precipitated crystal was collected by filtration and washed with ethanol to obtain Compound II-7.

Yield: 4.5 g; Melting point: 213° C. (dec.).

In the photosensitive material of the present invention, the compound represented by the formula [I]or [II] is preferably contained in surface latent image type silver halide emulsion layer, but may be contained in a hydrophilic colloid layer contiguous to the surface latent image type silver halide emulsion layer.

This hydrophilic colloid layer may be those which have any functions as far as diffusion of the compound represented by the formula [I] or [II] to silver halide grains is not inhibited, and examples are undercoat layer, intermediate layer, filter layer, protective layer, and antihalation layer.

Content of the compound of the present invention in the layer of the photosensitive material can vary over a wide range because it varies depending on characteristics of silver halide emulsion used, chemical structure of the compound and developing conditions, but is practically preferably about $1\times10^{-6}-1\times10^{-2}$ mol per 1 mol of silver in the surface latent image type silver halide emulsion.

When the hydrazine compound represented by the formula [I] or [II] is contained in a developer amount of the compound is suitably $10^{-4}-10^{-1}$ mol/l, more preferably $5\times10^{-4}-5\times10^{-2}$ mol/l.

The silver halide used in the photosensitive silver halide emulsion layer of the photosensitive material of the present invention has no special limitation and silver chlorobromide, silver chloroiodobromide, silver iodobromide, silver bromide and the like can be used. When silver iodobromide or silver chloroiodobromide is used, content of the silver iodide is preferably 5 mol % or less.

Form, habit and distribution of size of silver halide grains have no special limitations, but a grain size of 0.7 micron or less is preferred.

The silver halide emulsion can be increased in sensitivity, without coarsening the grains, with gold compounds such as chloraurate and gold trichloride, salts of noble metals such as rhodium and iridium, sulfur compounds which react with silver salt to produce silver sulfide, and reducing materials such as stannous salts and amines.

Furthermore, salts of noble metals such as rhodium and iridium or iron compounds such as red prussiate can be allowed to be present in pysical ripening of silver halide grains or in formation of nuclei.

Addition of rhodium salt or complex salt thereof is especially preferred since it further accelerates the effect of the present invention to attain photographic characteristics of super-high contrast in a short developing time.

In the present invention, the surface latent image type silver halide emulsion means the emulsion consisting of a silver halide grain which is higher in surface sensitivity than in internal sensitivity and is preferably one which has the difference between surface sensitivity and internal sensitivity as specified in U.S. Pat. No. 4,224,401.

The silver halide emulsion is preferably a monodispersed emulsion and especially preferably is one which has the monodipersibility as specified in the above U.S. Pat. No. 4,224,401.

The photographic emulsion used in the present invention may be spectrally sensitized with methine dyes and the like.

The dyes used include cyanine dyes, merocyanine dyes, composite cyanine dyes, composite merocyanine dyes, holopolar cyanine dyes, hemicyanine dyes, styryl dyes, and hemioxonol dyes.

Especially useful dyes are those which belong to cyanine dyes, merocyanine dyes, and composite merocyanine dyes.

These sensitizing dyes may be used singly or in combination.

The sensitizing dyes are often used in combination especially for supersensitization.

Dyes which per se have no spectral sensitization action or materials which do not substantially absorb visible light and show supersensitization action may be contained in the emulsion together with the sensitizing dyes.

As binders or protective colloids which can be used in emulsion layer or intermediate layer of the photosensitive material of the present invention, it is advantageous to use gelatin, but other hydrophilic colloids can also be used.

There may be used, for example, proteins such as gelatin derivatives, graft polymers of gelatin and other polymers, albumin, and casein; cellulose derivatives such as hydroxyethyl cellulose, carboxymethyl cellulose, and cellulose sulfate esters; sugar derivatives such as sodium alginate and starch derivatives; and various synthetic hydrophilic polymer substances, e.g., homopolymers or copolymers such as polyvinyl alcohol, partial acetal of polyvinyl alcohol, poly-N-vinylpyrrolidone, polyacrylic acid, polymethacrylic acid, polyacrylamide, and polyvinylimidazole.

As gelatin, there may be used lime-treated gelatin and besides, acid-treated gelatin and enzyme-treated gelatin described in Bull. Soc. Sci. Phot. Japan, No. 16, page 30 (1966) and furthermore, partial hydrolyzed or enzyme-treated product of gelatin can also be used.

The photographic emulsion used in the present invention can contain various compounds for inhibition of fogging in production, storage or photographic processing of the photosensitive materials or for stabilization of photographic performance.

That is, various compounds known as antifoggants or stabilizers can be contained. Examples thereof are azoles such as benzothiazolium salts, nitroimidazoles, nitrobenzimidazoles, chlorobenzimidazoles, mercaptothiazoles, mercaptobenzothiazoles, mercaptothiadiazoles, aminotriazoles, benzotriazoles, and mercaptotetrazoles; mercaptopyrimidines, mercaptotriazines, thioketo compounds; and azaindenes.

Among them, preferred are benzotriazoles (such as 5-methylbenzotriazoles) and nitroindazoles (such as 5-nitroindazole).

These compounds may be contained in the processing solution.

In the photosensitive material of the present invention, the photographic emulsion layer and other hydrophilic colloid layers may contain inorganic or organic hardeners.

For example, chromium salts such as chrome alum, aldehydes such as formaldehyde and glyoxal, N-methylol compounds, dioxane derivatives such as 2,3-dihydroxydioxane, active vinyl compounds, active halogen compounds such as 2,4-dichloro-6-hydroxy-S-triazine can be used singly or in combination.

The photographic emulsion layer or other hydrophilic colloid layers of the photosensitive materials of the present invention may contain coating aids, antistatic agents and various surface active agents for various purposes such as improvement of slipperiness, emulsification dispersion, inhibition of sticking, and improvement of photographic characteristics (such as acceleration of development, enhancement of contrast and sensitization).

Examples of the surface active agents are nonionic surface active agents, for example, saponin (steroid type), alkylene oxide derivatives (such as polyethylene glycol and polyethylene glycol alkyl ethers), glycidol derivatives (such as alkenylsuccinic polyglycerides), fatty acid esters of polyhydric alcohols, and alkyl esters of sugar; anionic surface active agents containing acid groups such as carboxyl group, sulfo group, phospho group, sulfate ester group, and phosphate ester group, for example, alkylcarboxylate salts, alkylsulfonate salts, alkylsulfate esters, and alkylphosphate esters; amphoteric surface active agents such as amino acids, aminoalkylsulfonic acids, aminoalkylsulfuric acids, and phosphate esters; and cationic surface active agents such as aliphatic or aromatic quaternary ammonium salts and heterocyclic quaternary ammonium salts such as pyridinium and imidazolium.

In the photosensitive material of the present invention, the photographic emulsion layer and other hydrophilic colloid layers may contain water-insoluble or slightly water soluble synthetic polymer decomposition products for improvement of dimensional stability.

For example, there may be used polymers containing as monomer components one or more of alkyl (meth)acrylates, alkoxyalkyl (meth)acrylates, glycidyl (meth)acrylates, (meth)acrylamides, vinyl acetate, acrylonitrile, olefins and styrene or combination of these monomers with acrylic acid, methacrylic acid, $\alpha,\beta$-unsaturated dicarboxylic acids, hydroxyalkyl (meth)acrylates, sulfoalkyl (meth)acrylates, or styrenesulfonic acid.

In order to obtain photographic characteristics of super-high contrast using the silver halide photosensitive materials of the present invention, it is not necessary to use the conventional lith developer or the highly alkaline developer having a pH of nearly 13 described in U.S. Pat. No. 2,419,975 and stable developers can be used.

That is, for the silver halide photographic photosensitive materials of the present invention, a developer containing sufficient sulfite ion (especially at least 0.15 mol/l as a preservative can be used and furthermore, sufficiently super-high contrast negative image can be obtained with a developer having a pH of 9.5 or more, especially 10.5–12.3.

The developing agent usable in the process of the present invention has no special limitation and dihydroxybenzenes, 3-pyrazolidones, aminophenols and the like can be used singly or in combination.

The developer may additionally contain pH buffers such as sulfates, carbonates, borates, and phosphates of alkali metals, and development retardants and antifoggants such as bromides, iodides, and organic antifoggants (especially preferably nitroindazoles and benzotriazoles).

Furthermore, if necessary, the developer may contain a water softener, a dissolution aid, color toning agent, a development accelerator, a surface active agent, an antifoamer, a hardener, an inhibitor for staining of film with silver (such as 2-mercaptobenzimidazolesulfonic acids), such as the like.

Examples of these additives are described in "Research Disclosure", No. 176, 17643.

As a fixer, there may be used those of generally used composition.

As the fixing agent, there may be used thiosulfates and thiocyanates, and besides organic sulfur compounds which are known to have the effect as a fixing agent.

The fixer may contain a water-soluble aluminum salt or the like as a hardener.

In the present invention, the developing agent may contain in the photosensitive materials and the photosensitive materials may be processed with an alkaline activator solution. (Japanese Patent Kokai Nos. 57-129436, 57-129433, 57-129434, and 57-129435 and U.S. Pat. No. 4,323,643).

The processing temperature is usually 18°–50° C., but may be lower than 18° C. or higher than 50° C.

The photographic processing is preferably carried out using an automatic processor.

According to the present invention, photographic characteristics of sufficiently super-high contrast negative gradation can be obtained even when total processing time from entering of the photosensitive material into the automatic processor to leaving of the material from the processor is set at from 60 seconds to 120 seconds.

EXAMPLE 1

A silver iodobromide emulsion comprising cubic grains of 0.25 $\mu$ in average grain size which contained 97% of AgBr and 3% of AgI was prepared by double jet process and was subjected to washing with water and redissolution by conventional methods and then to chemical sensitization using sodium thiosulfate.

This silver iodobromide emulsion was divided into 13 portions. Then, thereto was added Compound I-1, I-5, I-8, or I-11 or Comparative Compound (A) or (B) in an amount as shown in Table 1 and each of the emulsions was coated on a polyester film so that amount of silver was 3.7 g per 1 $m^2$.

Each of the thus produced films was subjected to wedge exposure and developed with a developer having the following composition at 20° C. for 1–5 minutes.

| Developer: | |
|---|---|
| Hydroquinone | 30 g |
| 4-Hydroxymethyl-4-methyl-1-phenyl-3-pyrazolidone | 0.3 g |
| Sodium sulfite | 75 g |
| EDTA.2Na | 1.0 g |
| Tripotassium phosphate | 80 g |
| Potassium bromide | 2.0 g |
| NaOH | 13 g |
| 5-Methylbenzotriazole | 0.3 g |
| 1-Diethylamino-2,3-dihydroxypropane | 17 g |
| Water to make up 1 liter. | |

This was adjusted to a pH of 11.5 with potassium hydroxide.

Comparative Compound (A)

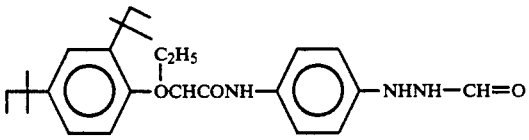

Comparative Compound (B)

-continued

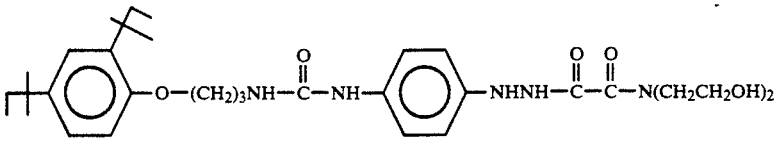

The results are shown in Table 1.

As can be seen from Table 1, when the compound of the present invention was used, the photographic characteristics of high contrast were nearly completed even by the development at 20° C. for 1 minute as compared with using the Comparative Compound (A) and fog did not increase even if the development is carried out for a long time.

More surprisingly, in spite of the fact that difference in structure between Comparative Compound (B) and the compound of the present invention is very slight, the advantageous effect of the compound of the present invention was clear and it is suggested that the compound of the present invention represented by the formula [I] was effective.

Furthermore, change in sensitivity with change in developing time was very small when the compound of the present invention was used than when Comparative Compound (A) or (B) was used and it can be seen therefrom that stability against development of the compound of the present invention is high.

Moreover, when unexposed portion of each sample after developed was observed, in the case of the samples (Nos. 2–5) which contained Comparative Compound (A) or (B), clear pepper fog already occurred by the development of 3 minutes while no pepper fog was recognized in the samples (Nos. 6–13) which contained the compound of the present invention.

TABLE 1

| | | | Developing time (20° C.) | | | | | |
|---|---|---|---|---|---|---|---|---|
| | | | 1 minute | | | 2 minutes | | |
| Film No. | Name of compound | a) Addition amount | b) Sensitivity | c) Gamma | Fog | b) Sensitivity | c) Gamma | Fog |
| 1 | Non | | 8.1 | 4.0 | 0.00 | 9.1 | 4.0 | 0.00 |
| 2 | Comparative Compound (A) | $2.0 \times 10^{-4}$ | 25.1 | 3.0 | " | 55.3 | 8.5 | " |
| 3 | Comparative Compound (A) | $2.5 \times 10^{-3}$ | 30.2 | 3.5 | " | 75.9 | 10.0 | " |
| 4 | Comparative Compound (B) | $2.0 \times 10^{-4}$ | 20.5 | 2.5 | " | 51.3 | 8.5 | 0.01 |
| 5 | Comparative Compound (B) | $2.5 \times 10^{-3}$ | 27.3 | 3.0 | " | 70.8 | 9.5 | 0.02 |
| 6 | Compound I-1 | $2.0 \times 10^{-4}$ | 92.0 | 8.5 | " | 120.0 | >10 | 0.00 |
| 7 | " | $2.5 \times 10^{-3}$ | 100.0 | 9.5 | " | 125.0 | >10 | " |
| 8 | Compound I-5 | $2.0 \times 10^{-4}$ | 75.0 | 8.5 | " | 91.0 | >10 | " |
| 9 | " | $2.5 \times 10^{-3}$ | 80.0 | 9.5 | " | 93.0 | >10 | " |
| 10 | Compound I-8 | $2.0 \times 10^{-4}$ | 79.0 | 9.0 | " | 100.0 | >10 | " |
| 11 | " | $2.5 \times 10^{-3}$ | 83.0 | 9.5 | " | 111.0 | >10 | " |
| 12 | Compound I-11 | $2.0 \times 10^{-4}$ | 85.0 | 9.0 | " | 115.0 | >10 | " |
| 13 | " | $2.5 \times 10^{-3}$ | 95.0 | 9.5 | " | 125.0 | >10 | " |

| | | | Developing time (20° C.) | | | | | |
|---|---|---|---|---|---|---|---|---|
| | | | 3 minutes | | | 5 minutes | | |
| Film No. | Name of compound | a) Addition amount | b) Sensitivity | c) Gamma | Fog | b) Sensitivity | c) Gamma | Fog |
| 1 | Non | | 10.0 | 4.1 | 0.00 | 10.2 | 4.0 | 0.02 |
| 2 | Comparative Compound (A) | $2.0 \times 10^{-4}$ | 76.8 | >10 | 0.05 | 111.0 | >10 | 0.10 |
| 3 | Comparative Compound (A) | $2.5 \times 10^{-3}$ | 89.1 | >10 | 0.07 | 138.0 | >10 | 0.15 |
| 4 | Comparative Compound (B) | $2.0 \times 10^{-4}$ | 75.0 | 9.5 | 0.08 | 110.0 | >10 | 0.16 |
| 5 | Comparative Compound (B) | $2.5 \times 10^{-3}$ | 86.5 | >10 | 0.10 | 135.0 | >10 | 0.20 |
| 6 | Compound I-1 | $2.0 \times 10^{-4}$ | 125.0 | >10 | 0.00 | 130.0 | >10 | 0.01 |
| 7 | " | $2.5 \times 10^{-3}$ | 128.0 | >10 | " | 135.0 | >10 | 0.02 |
| 8 | Compound I-5 | $2.0 \times 10^{-4}$ | 104.0 | >10 | " | 116.0 | >10 | 0.01 |
| 9 | " | $2.5 \times 10^{-3}$ | 106.0 | >10 | " | 123.0 | >10 | " |
| 10 | Compound I-8 | $2.0 \times 10^{-4}$ | 110.0 | >10 | " | 120.0 | >10 | " |
| 11 | " | $2.5 \times 10^{-3}$ | 117.0 | >10 | " | 123.0 | >10 | " |
| 12 | Compound I-11 | $2.0 \times 10^{-4}$ | 121.0 | >10 | " | 131.0 | >10 | " |
| 13 | " | $2.5 \times 10^{-3}$ | 130.0 | >10 | " | 133.0 | >10 | 0.02 |

a): Amount of compound added was shown by number of mols based on 1 mol of silver.
b): Sensitivity was shown by exposure required for providing a density of 1.0 (relative sensitivity when sensitivity of Film No. 1 was developed for 3 minutes is assumed to be 10.0).
c): Gamma means average gradient of density of from 0.5 to 2.0.

EXAMPLE 2

A part of the film samples obtained in Example 1 were heated to 40° C. for 30 days and were subjected to exposure and development (at 20° C. for 3 minutes) in the same manner as in Example 1 and sensitivity and fog were compared with those of the samples just after coating of the emulsion.

The results are shown in Table 2.

TABLE 2

| Film No. | Compound | Just after coating Sensitivity | Just after coating Fog | Heated at 40° C. for 30 days Sensitivity | Heated at 40° C. for 30 days Fog |
|---|---|---|---|---|---|
| 1 | Non | 10.0 | 0.00 | 10.5 | 0.02 |
| 2 | Comparative Compound (A) | 76.8 | 0.05 | 80.5 | 0.10 |
| 3 | Comparative Compound (A) | 89.1 | 0.07 | 92.3 | 0.13 |
| 4 | Comparative Compound (B) | 75.0 | 0.08 | 74.0 | 0.09 |
| 5 | Comparative (Compound(B) | 86.5 | 0.10 | 89.0 | 0.01 |
| 6 | Compound I-1 | 125.0 | 0.00 | 126.0 | 0.01 |
| 7 | " | 128.0 | " | 128.0 | " |
| 8 | Compound I-5 | 104.0 | " | 105.0 | " |
| 9 | " | 106.0 | " | 106.0 | 0.00 |
| 10 | Compound I-8 | 110.0 | " | 111.0 | " |
| 11 | " | 117.0 | " | 118.0 | " |
| 12 | Compound I-11 | 121.0 | " | 121.0 | 0.01 |
| 13 | " | 130.0 | " | 131.0 | " |

As is clear from Table 2, when the compound of the present invention was used, change in sensitivity and increase in fog were little during storage.

EXAMPLE 3

Test on dot image quality was conducted using another part of the film samples obtained in Example 1.

That is, each sample was exposed through a wedge for sensitometry using a grey contact screen of 150 lines and then, developed with the same developer as used above at 38° C. for 30 seconds and dot image quality was evaluated.

The results are shown in Table 3.

Dot image quality was visually evaluated in five grades and grade 5 means the best dot image quality and grade 1 means the worst dot image quality. The samples of grade 5 and grade 4 can be practically used as dot image material for plate making, that of grade 3 is inferior, but can be barely used, and those of grade 2 and grade 1 cannot be practically used.

TABLE 3

| Film No. | Compound | Dot image quality |
|---|---|---|
| 1 | Non | 1 |
| 2 | Comparative Compound (A) | 3 |
| 3 | Comparative Compound (A) | 3 |
| 4 | Comparative Compound (B) | 3 |
| 5 | Comparative Compound (B) | 3 |
| 6 | Compound I-1 | 5 |
| 7 | " | 5 |
| 8 | Compound I-5 | 5 |
| 9 | " | 5 |
| 10 | Compound I-8 | 4 |
| 11 | " | 5 |
| 12 | Compound I-11 | 5 |
| 13 | " | 5 |

As is clear from Table 3, the compounds of the present invention provided good dot image quality.

EXAMPLE 4

Example 1 was repeated except that Compounds II-2, II-3, II-7 and II-13 were used as the compounds of the present invention.

The results are shown in Table 4.

As can be seen from Table 4, when the compound of the present invention was used, the photographic characteristics of high contrast were nearly completed even by the development at 20° C. for 1 minute as compared with using the Comparative Compound (A) and that fog did not increase even if the development was carried out for a long time.

Furthermore, change in sensitivity with change in developing time was very small when the compound of the present invention was used than when Comparative compound (A) or (B) was used and it can be seen therefrom that stability against development of the compound of the present invention is high.

Moreover, when unexposed portion of each sample after developed was observed, in the case of the samples (Nos. 15–18) which contained Comparative Compound (A) or (B), clear paper fog already occurred by the development of 3 minutes while no paper fog was recognized in the samples (Nos. 19–26) which contained the compound of the present invention.

TABLE 4

| Film No. | Name of compound | a) Addition amount | Developing time (20° C.) 1 minute b) Sensitivity | 1 minute c) Gamma | 1 minute Fog | 2 minutes b) Sensitivity | 2 minutes c) Gamma | 2 minutes Fog |
|---|---|---|---|---|---|---|---|---|
| 14 | Non | | 8.1 | 4.0 | 0.00 | 9.1 | 4.0 | 0.00 |
| 15 | Comparative Compound (A) | $2.0 \times 10^{-4}$ | 25.1 | 3.0 | " | 55.3 | 8.5 | " |
| 16 | Comparative Compound (A) | $2.5 \times 10^{-3}$ | 30.2 | 3.5 | " | 75.9 | 10.0 | " |
| 17 | Comparative Compound (B) | $2.0 \times 10^{-4}$ | 20.5 | 2.5 | " | 51.3 | 8.5 | 0.01 |
| 18 | Comparative Compound (B) | $2.5 \times 10^{-3}$ | 27.3 | 3.0 | " | 70.8 | 9.5 | 0.02 |
| 19 | Compound II-2 | $2.0 \times 10^{-4}$ | 75.0 | 8.5 | " | 90.5 | >10 | 0.00 |
| 20 | " | $2.5 \times 10^{-3}$ | 80.0 | 9.5 | " | 92.5 | >10 | " |
| 21 | Compound II-3 | $2.0 \times 10^{-4}$ | 79.0 | 9.0 | " | 100.0 | >10 | " |
| 22 | " | $2.5 \times 10^{-3}$ | 83.0 | 9.7 | " | 110.0 | >10 | " |
| 23 | Compound II-7 | $2.0 \times 10^{-4}$ | 81.0 | 9.0 | " | 110.0 | >10 | " |
| 24 | " | $2.5 \times 10^{-3}$ | 95.0 | 9.0 | " | 115.0 | >10 | " |
| 25 | Compound II-13 | $2.0 \times 10^{-4}$ | 91.0 | 8.5 | " | 120.0 | >10 | " |
| 26 | " | $2.5 \times 10^{-3}$ | 100.0 | >10 | " | 125.0 | >10 | " |

Developing time (20° C.)

TABLE 4-continued

| Film No. | Name of compound | a) Addition amount | 3 minutes b) Sensitivity | 3 minutes c) Gamma | 3 minutes Fog | 5 minutes b) Sensitivity | 5 minutes c) Gamma | 5 minutes Fog |
|---|---|---|---|---|---|---|---|---|
| 14 | Non | | 10.0 | 4.1 | 0.00 | 10.2 | 4.0 | 0.02 |
| 15 | Comparative Compound (A) | $2.0 \times 10^{-4}$ | 76.8 | >10 | 0.05 | 111.0 | >10 | 0.10 |
| 16 | Comparative Compound (A) | $2.5 \times 10^{-3}$ | 89.1 | >10 | 0.07 | 138.0 | >10 | 0.15 |
| 17 | Comparative Compound (B) | $2.0 \times 10^{-4}$ | 75.0 | 9.5 | 0.08 | 110.0 | >10 | 0.16 |
| 18 | Comparative Compound (B) | $2.5 \times 10^{-3}$ | 86.5 | >10 | 0.10 | 135.0 | >10 | 0.20 |
| 19 | Compound II-2 | $2.0 \times 10^{-4}$ | 103.0 | >10 | 0.00 | 115.0 | >10 | 0.01 |
| 20 | " | $2.5 \times 10^{-3}$ | 105.0 | >10 | " | 120.0 | >10 | " |
| 21 | Compound II-3 | $2.0 \times 10^{-4}$ | 109.0 | >10 | " | 119.0 | >10 | " |
| 22 | " | $2.5 \times 10^{-3}$ | 116.0 | >10 | " | 120.0 | >10 | " |
| 23 | Compound II-7 | $2.0 \times 10^{-4}$ | 121.0 | >10 | " | 131.0 | >10 | 0.02 |
| 24 | " | $2.5 \times 10^{-3}$ | 125.0 | >10 | " | 133.0 | >10 | 0.01 |
| 25 | Compound II-13 | $2.0 \times 10^{-4}$ | 125.0 | >10 | " | 130.0 | >10 | " |
| 26 | " | $2.5 \times 10^{-3}$ | 127.0 | >10 | " | 135.0 | >10 | " |

a), b), and c) are the same as in Table 1.

EXAMPLE 5

A part of the film samples obtained in Example 4 were heated to 40° C. for 30 days and were subjected to exposure and development (at 20° C. for 3 minutes) in the same manner as in Example 4 and sensitivity and fog were compared with those of the samples just after coating of the emulsion.

The results are shown in Table 5.

TABLE 5

| Film No. | Compound | Just after coating Sensitivity | Just after coating Fog | Heated at 40° C. for 30 days Sensitivity | Heated at 40° C. for 30 days Fog |
|---|---|---|---|---|---|
| 14 | Non | 10.0 | 0.00 | 10.5 | 0.02 |
| 15 | Comparative Compound (A) | 76.8 | 0.05 | 80.5 | 0.10 |
| 16 | Comparative (Compound (A) | 89.1 | 0.07 | 92.3 | 0.13 |
| 17 | Comparative Compound (B) | 75.0 | 0.08 | 74.0 | 0.09 |
| 18 | Comparative Compound (B) | 86.5 | 0.10 | 89.0 | 0.11 |
| 19 | Compound II-2 | 103.0 | 0.00 | 103.5 | 0.00 |
| 20 | " | 105.0 | " | 106.0 | " |
| 21 | Compound II-3 | 109.0 | " | 109.0 | " |
| 22 | " | 116.0 | " | 116.5 | " |
| 23 | Compound II-7 | 121.0 | " | 122.0 | " |
| 24 | " | 125.0 | " | 124.8 | 0.01 |
| 25 | Compound I-13 | " | " | 126.0 | " |
| 26 | " | 127.0 | " | 128.0 | " |

As is clear from Table 5, when the compound of the present invention was used, change in sensitivity and increase in fog were little during storage.

EXAMPLE 6

Test on dot image quality was conducted using another part of the film samples obtained in Example 4.

That is, each sample was exposed through a wedge for sensitometry using a grey contact screen of 150 lines and then, developed with the same developer as used above at 38° C. for 30 seconds and dot image quality was evaluated.

The results are shown in Table 6.

Dot image quality was visually evaluated in five grades and grade 5 means the best dot image quality and grade 1 means the worst dot image quality. The samples of grade 5 and grade 4 can be practically used as dot image material for plate making, that of grade 3 is inferior, but can be barely used, and those of grade 2 and grade 1 cannot be practically used.

TABLE 6

| Film No. | Compound | Dot image quality |
|---|---|---|
| 14 | Non | 1 |
| 15 | Comparative Compound (A) | 3 |
| 16 | Comparative Compound (A) | 3 |
| 17 | Comparative Compound (B) | 3 |
| 18 | Comparative Compound (B) | 3 |
| 19 | Compound II-2 | 5 |
| 20 | " | 4 |
| 21 | Compound II-3 | 4 |
| 22 | " | 5 |
| 23 | Compound II-7 | 5 |
| 24 | " | 4 |
| 25 | Compound II-13 | 5 |
| 26 | " | 5 |

As can be seen from Table 6, the compounds of the present invention provide good dot image quality.

What is claimed is:

1. A method for high contrast image formation which comprises developing an image-wise exposed a silver halide photographic photosensitive material in the presence of a compound represented by the following formula

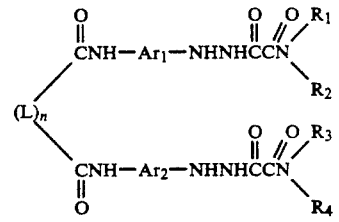

wherein $Ar_1$ and $Ar_2$ may be identical or different and each represents a divalent aromatic group, $R_1$, $R_2$ and $R_3$ and $R_4$ may be identical or different and each represents a hydrogen atom, an alkyl group, an aryl group or a heterocyclic group, $R_1$ and $R_2$ may link to each other to form a ring and $R_3$ and $R_4$ may link to each other to from a ring, L represents a divalent linkage group, and n represents 0 or 1.

2. A method according to claim 1, wherein the divalent aromatic group represented by $Ar_1$ and $Ar_2$ in the formula is a phenylene or naphthyl group which may have a substituent.

3. A method according to claim 1, wherein the divalent aromatic group represented by $R_1$, $R_2$, $R_3$ and $R_4$ in the formula is an alkyl group having 30 or less carbon atoms.

4. A method according to claim 1, wherein the aryl group represented by $R_1$, $R_2$, $R_3$ and $R_4$ in the formula is a phenyl or naphthyl group which may have substituent.

5. A method according to claim 1, wherein the heterocyclic group represented by $R_1$, $R_2$, $R_3$ and $R_4$ in the formula is monocyclic or bicyclic group.

6. A method according to claim 1, wherein the divalent linkage group represented by L in the formula is a linkage group represented by the following formula [III], [IV] or [V]:

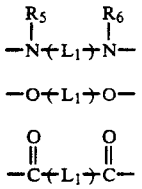

[III]

$$-O\leftarrow L_1\rightarrow O- \quad [IV]$$

[V]

wherein $L_1$ represents an atom or atomic group comprising at least one of C, N, S, and O, $R_5$ and $R_6$ each represents a hydrogen atom, an alkyl group, an aryl group or a heterocyclic group and $R_5$ and $R_6$ may link to each other to form a ring.

7. A method according to claim 1, wherein the compound represented by the formula is contained in a silver halide emulsion layer or a hydrophilic colloid layer contiguous to the emulsion layer of the photosensitive material.

8. A method according to claim 1, wherein the compound represented by the formula is contained in a developer used for development of the photosensitive material.

9. A method according to claim 7, wherein amount of the compound is about $1\times10^{-6}1\times10^{-2}$ mol per 1 mol of silver in the emulsion.

10. A method according to claim 8, wherein amount of the compound is $10^{-4}10^{-1}$ ml/l.

11. A silver halide photosensitive material which contains the compound represented by the formula

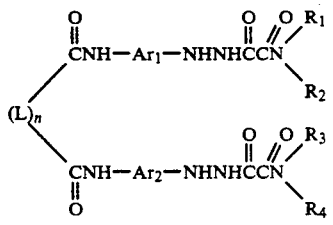

wherein $Ar_1$ and $Ar_2$ may be identical or different and each represents a divalent aromatic group, $R_1$, $R_2$ and $R_3$ and $R_4$ may be identical or different and each represents a hydrogen atom, an alkyl group, an aryl group or a heterocyclic group, $R_1$ and $R_2$ may link to each other to form a ring and $R_3$ and $R_4$ may link to each other to form a ring, L represents a divalent linkage group, and n represents 0 or 1.

* * * * *